US009362637B2

(12) United States Patent
Hasegawa

(10) Patent No.: US 9,362,637 B2
(45) Date of Patent: Jun. 7, 2016

(54) ELECTRICAL CONNECTOR HAVING A LOCK FITTING WITH A BOTTOM PORTION CONNECTING A LOCK PLATE PORTION AND AN REINFORCING PLATE PORTION

(71) Applicant: HIROSE ELECTRIC CO., LTD., Tokyo (JP)

(72) Inventor: Yohei Hasegawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/808,799

(22) Filed: Jul. 24, 2015

(65) Prior Publication Data

US 2016/0036145 A1 Feb. 4, 2016

(30) Foreign Application Priority Data

Jul. 29, 2014 (JP) ..... 2014-153875

(51) Int. Cl.
*H01R 12/00* (2006.01)
*H01R 12/70* (2011.01)

(52) U.S. Cl.
CPC ..... *H01R 12/7076* (2013.01)

(58) Field of Classification Search
CPC .... H01R 9/091; H01R 12/70; H01R 12/7076; H01R 12/73
USPC ..... 439/55, 65, 74, 78
See application file for complete search history.

(56) References Cited

U.S. PATENT DOCUMENTS 7,172,434 B2 * 2/2007 Obikane ..... H01R 24/60 439/570
7,384,274 B1 * 6/2008 Chen ..... H01R 12/714 439/74
7,585,185 B2 * 9/2009 Obikane ..... H01R 13/65802 439/108
7,736,177 B2 * 6/2010 Tsai ..... H01R 12/57 439/570
7,845,958 B2 * 12/2010 Hoshino ..... H01R 12/716 439/660
7,931,477 B2 * 4/2011 Hirata ..... H01R 12/716 439/74
8,083,527 B2 * 12/2011 Takeuchi ..... H01R 13/26 439/65
8,845,339 B2 * 9/2014 Ono ..... H01R 12/7052 439/74
9,124,011 B2 * 9/2015 Miyazaki ..... H01R 12/716
9,225,086 B2 * 12/2015 Takeuchi ..... H01R 12/716
2013/0012039 A1 * 1/2013 Nose ..... H01R 12/716 439/74
2013/0210270 A1 * 8/2013 Takeuchi ..... H01R 12/716 439/488
2013/0295784 A1 * 11/2013 Hasegawa ..... H01R 9/091 439/55

FOREIGN PATENT DOCUMENTS

JP 2013-206771 10/2013

* cited by examiner

*Primary Examiner* — Chandrika Prasad
(74) *Attorney, Agent, or Firm* — Procopio, Cory, Hargreaves & Savitch LLP

(57) ABSTRACT

To provide an electrical connector for circuit boards having lock fittings designed to reliably prevent damage to lock portions and inadvertent removal of mating connectors. The lock fittings have lock plate portions that extend along the inner surface of the lateral walls of the housing and are retained in place on said lateral walls, or which extend along the inner surface of the end walls and are retained in place on said end walls; upright face-reinforcing plate portions that extend along the upright faces of the protruding wall of the housing facing said lock plate portions and are retained in place on said protruding wall; and connecting bottom portions that extend along the bottom wall and connect the bottom wall-adjacent end portions of the lock plate portions and the upright face-reinforcing plate portions.

5 Claims, 6 Drawing Sheets

ELECTRICAL CONNECTOR HAVING A LOCK FITTING WITH A BOTTOM PORTION CONNECTING A LOCK PLATE PORTION AND AN REINFORCING PLATE PORTION

The present application claims the benefit of foreign priority under 35 USC §119 based Japanese Patent Application No. 2014-153875, filed Jul. 29, 2014, the contents of which is incorporated herein in its entirety by reference.

BACKGROUND

1. Field

The present invention relates to an electrical connector for circuit boards that is disposed on a mounting face of a circuit board and allows for a mating connector to be inserted and extracted therefrom such that the direction of connector insertion and extraction is a direction perpendicular to said mounting face, and, in particular, relates to an electrical connector for circuit boards having lock fittings lockable onto a mating connector in the direction of connector extraction.

2. Related Art

Known electrical connectors of this type include, for example, the receptacle connector described in Patent Document 1. In Patent Document 1, the receptacle connector has a housing that is disposed on a mounting face of a circuit board and extends such that its longitudinal direction is a direction parallel to said mounting face, multiple terminals are retained in place on the housing in an array form such that the terminal array direction is said longitudinal direction, and lock fittings are retained in place on said housing at both ends of the housing outside the terminal array area in the terminal array direction.

The housing has a bottom wall that faces the above-mentioned mounting face, a protruding wall that rises up in the central portion of said bottom wall and extends in the above-mentioned terminal array direction, and a perimeter wall that rises up around the perimeter of said bottom wall and surrounds the above-mentioned protruding wall. Said perimeter wall has a pair of lateral walls that extend in the terminal array direction, and a pair of end walls that extend in the connector width direction (transverse direction of the housing), which are perpendicular thereto. An annular space, which is upwardly open between the above-mentioned protruding wall and the above-mentioned perimeter wall, is formed as a receiving portion for receiving a mating portion of a mating connector from above.

The lock fittings are fabricated by bending sheet metal members, and, in addition to base portions, which have a substantially U-shaped configuration when viewed in the direction of connector insertion and extraction, each have two retained portions that extend from said base portions, lateral wall-adjacent lock arm portions, and end wall-adjacent lock arm portions.

The base portions have end wall-adjacent base portions, which extend in the connector width direction, and lateral wall-adjacent base portions, which are bent at both ends of said end wall-adjacent base portions and extend in the terminal array direction. The retained portions extend along the lateral walls of the housing from the lower edges of the lateral wall-adjacent base portions in a substantially L-shaped configuration when viewed in the terminal array direction, and press-fit arm portions extending in the direction of connector insertion and extraction in this substantially L-shaped configuration are press-fitted and retained in corresponding grooves in the lateral walls of the housing. The lateral wall-adjacent lock arm portions, which extend inwardly in the terminal array direction from the lateral wall-adjacent base portions in a cantilever configuration, are made elastically bendable in the sheet thickness direction (connector width direction). The end wall-adjacent lock arm portions, which are folded back in a U-shaped configuration at the lower edges of the end wall-adjacent base portions at locations in the vicinity of the bottom wall of the housing and extend in the direction of connector extraction, are made elastically bendable in the sheet thickness direction (terminal array direction). On the respective major surfaces of the lateral wall-adjacent lock arm portions and end wall-adjacent lock arm portions, there are formed lock portions extending towards the receiving portion of the housing, which engage and lock with the corresponding lock portions provided in the plug connector used as the mating connector when the connectors are mated.

PRIOR-ART LITERATURE

Patent Literature

[Patent Document 1]

Japanese Patent Application Publication No. 2013-206771.

Problems to be Solved by the Invention

In the receptacle connector of Patent Document 1, the lock fittings have their retained portions retained in place on the housing, while the lateral wall-adjacent lock arm portions and end wall-adjacent lock arm portions themselves extend in a cantilever configuration without being retained in place on the housing, such that a gap is formed between them and the housing, and are made readily elastically displaceable in the sheet thickness direction with the fulcrum being at the boundary with the base portions. In such a configuration, when a high upwardly-directed external force acts on the lateral wall-adjacent lock arm portions and the end wall-adjacent lock arm portions, the lateral wall-adjacent lock arm portions and end wall-adjacent lock arm portions are displaced in the direction of connector extraction with the fulcrum being at the boundary with the above-mentioned base portions. Consequently, when an excessive extraction force inadvertently acts on the plug connector in a mated state, the end wall-adjacent lock arm portions and lateral wall-adjacent lock arm portions are raised to an excessive degree in the direction of connector extraction while the lock portions are engaged with the corresponding lock portions of the mating connector, thereby creating a risk of deformation and damage, and in addition, disengagement from the plug connector.

SUMMARY

The present invention takes such circumstances into consideration, and it is an object of the invention to provide an electrical connector for circuit boards having lock fittings designed to reliably prevent damage to the lock portions and inadvertent removal of the mating connector.

First Invention

The electrical connector for circuit boards according to a first invention, which is an electrical connector for circuit boards that is disposed on a mounting face of a circuit board and allows for a mating connector to be inserted and extracted therefrom such that the direction of connector insertion and extraction is a direction perpendicular to said mounting face, has terminals and lock fittings arranged such that the direction of the array is a single direction parallel to the above-mentioned mounting face and a housing that has said terminals and lock fittings retained thereon in an array form; said housing has a bottom wall that faces the above-mentioned mounting face, a protruding wall that rises up from said bottom wall and extends in the above-mentioned array direction, and a perimeter wall that rises up from said bottom wall and surrounds the above-mentioned protruding wall; said perimeter wall has a pair of lateral walls that extend in above-mentioned array direction and a pair of end walls that extend in the connector width direction perpendicular to the above-mentioned array direction and couple the end portions of the pair of lateral walls; and an annular space between the above-mentioned protruding wall and the above-mentioned perimeter wall is formed as a receiving portion that receives a mating portion of a mating connector from the open side of said annular space; and the lock fittings, which are made by bending sheet metal members, are retained in place on the housing at locations outwards of the above-mentioned terminals in the above-mentioned array direction and are lockable onto a mating connector in the direction of connector extraction.

In such an electrical connector for circuit boards, in the first invention, the lock fittings have lock plate portions that extend along the inner surfaces of the lateral walls of the housing and are retained in place on said lateral walls or extend along the inner surfaces of the end walls and are retained in place on said end walls, upright face-reinforcing plate portions that extend along the upright faces of the protruding wall of the housing facing said lock plate portions and are retained in place on said protruding wall, and connecting bottom portions that extend along the bottom wall and connect the bottom wall-adjacent end portions of the upright face-reinforcing plate portions and the lock plate portions.

Since in the first invention the lock plate portions of the lock fittings are retained in place on the lateral walls or end walls of the housing, no elastic displacement of the lock plate portions occurs before or after connector mating. Therefore, even if an excessive extraction force inadvertently acts on the mating connector in the direction of connector extraction, the lock plate portions do not get deformed or damaged. As a result, the locked state is maintained and inadvertent removal of the mating connector is prevented.

In addition, since in the first invention the lock fittings also have upright face-reinforcing plate portions retained in place on the protruding wall of the housing, said upright face-reinforcing plate portions can protect the upright faces of the protruding wall from damage due to interference with the mating connector in the process of connector insertion and extraction.

Furthermore, the lock plate portions are connected via the connecting bottom portions to the upright face-reinforcing plate portions retained in place on the protruding wall of the housing such that the upright face-reinforcing plate portions and the lock plate portions provide mutual reinforcement. Accordingly, even if an excessive extraction force inadvertently acts on the mating connector, the lock plate portions will be able to resist the above-mentioned extraction force with a greater force and will thus be able to prevent deformation and damage to the lock plate portions.

In the first invention, the lock fittings may have face-reinforcing top plate portions that extend from the open-side end portions of the upright face-reinforcing plate portions along the top portions of the protruding wall of the housing and are retained in place on said protruding wall. Thus, as a result of providing the lock fittings with the face-reinforcing top plate portions, the face-reinforcing top plate portions can protect the top face of the protruding wall from damage due to interference with the mating connector in the process of connector insertion and extraction. Since not only the upright face-reinforcing plate portions, but also the face-reinforcing top plate portions are retained in place on the protruding wall, the number of locations of the lock fittings retained on the protruding wall increases. As a result, the lock plate portions connected to the face-reinforcing top plate portions and upright face-reinforcing plate portions via the connecting bottom portions can resist inadvertent extraction forces with an even greater force, thereby making it possible to reliably prevent deformation and damage to the lock plate portions.

In the first invention, the lock fittings may have retained portions that extend from the open-side end portions of the lock plate portions via transitional portions towards the bottom wall side of the housing and are retained in place on the housing. As a result of providing the lock fittings with the retained portions in this manner, the retained portions are coupled to the lock plate portions via the transitional portions. As a result, the number of locations of the lock fittings retained in place on the housing increases, thereby enabling the lock plate portions coupled to the retained portions via the transitional portions to resist inadvertent extraction forces with an even greater force and allows for deformation and damage to the lock plate portions to be reliably prevented.

In the first invention, the lock fittings may have coupling portions that extend along the end walls in the connector width direction, each of the two lateral walls may be respectively provided with one lock plate portion, and said two lock plate portions may be coupled via the above-mentioned coupling portions.

Second Invention

The electrical connector for circuit boards according to the second invention, which is an electrical connector for circuit boards that is disposed on a mounting face of a circuit board and allows for a mating connector to be inserted and extracted therefrom such that the direction of connector insertion and extraction is a direction perpendicular to said mounting face, has terminals and lock fittings arranged such that the direction of the array is a single direction parallel to the above-mentioned mounting face and a housing that has said terminals and lock fittings retained thereon in an array form; said housing has a bottom wall that faces the above-mentioned mounting face, a protruding wall that rises up from said bottom wall and extends in the above-mentioned array direction, and a perimeter wall that rises up from said bottom wall and surrounds the above-mentioned protruding wall; said perimeter wall has a pair of lateral walls that extend in above-mentioned array direction and a pair of end walls that extend in the connector width direction perpendicular to the above-mentioned array direction and couple the end portions of the pair of lateral walls; and an annular space between the above-mentioned protruding wall and the above-mentioned perimeter wall is formed as a receiving portion that receives a mating portion of a mating connector from the open side of said annular space; and the lock fittings, which are made by bending sheet metal members, are retained in place on the housing at locations outwards of the above-mentioned terminals in the above-mentioned array direction and are lockable onto a mating connector in the direction of connector extraction.

In the electrical connector for circuit boards of the present invention, the lock fittings are characterized by having: lock plate portions that extend along the inner surface of each of the respective two lateral walls of the housing and are retained in place on the lateral walls with one lock plate portion provided per wall, upright face-reinforcing plate portions that extend along the upright face of the protruding wall of the housing facing a lock plate portion on one side among the lock plate portions retained in place on each of the two lateral walls and which are retained in place on said protruding wall, connecting bottom portions that extend along the bottom wall and connect the bottom wall-adjacent end portion of the upright face-reinforcing plate portion and the above-mentioned lock plate portion on one side, extension portions that extend from the bottom wall-adjacent end portions of the lock plate portions on the other side along the bottom wall towards the protruding wall, and contact arm portions that extend from the above-mentioned extension portions along the upright face of the protruding wall of the housing facing said lock plate portions on the other side and which can be brought into contact with counterpart terminals provided in a mating connector under a contact pressure as a result of elastic displacement in the connector width direction.

In the second invention, in the same manner as in the previously described first invention, deformation and damage to the lock plate portions is prevented even if an excessive extraction force inadvertently acts on the mating connector because the lock plate portions of the lock fittings, along with being retained in place on the lateral walls or end walls of the housing, are connected to the upright face-reinforcing plate portions via the connecting bottom portions. In addition, in the same manner as in the first invention, the upright face-reinforcing plate portions can protect the upright face of the protruding wall from damage due to interference with the mating connector in the process of connector insertion and extraction. Furthermore, since in the second invention the contact arm portions can be used to provide contact with counterpart terminals under a contact pressure, the lock fittings can be used as terminals as well.

Effects of the Invention

Due to the fact that in the inventive electrical connector for circuit boards the lock plate portions of the lock fittings are retained in place on the lateral walls of the housing and, in addition, are coupled to the upright face-reinforcing plate portions retained in place on the protruding wall, which provides mutual reinforcement, even if an excessive extraction force inadvertently acts on a counterpart lock fitting when the connectors are in a mated state, the lock plate portions may create a large opposing force resisting the above-mentioned extraction force, thereby making it possible to prevent deformation and damage to the lock plate portions, and, furthermore, making it possible to reliably maintain the locking feature and prevent inadvertent removal of the mating connector.

An oblique view of a receptacle connector and a plug connector mated therewith from above according to a first embodiment of the present invention, illustrating a state prior to connector mating.

FIG. 2

Figure 1:
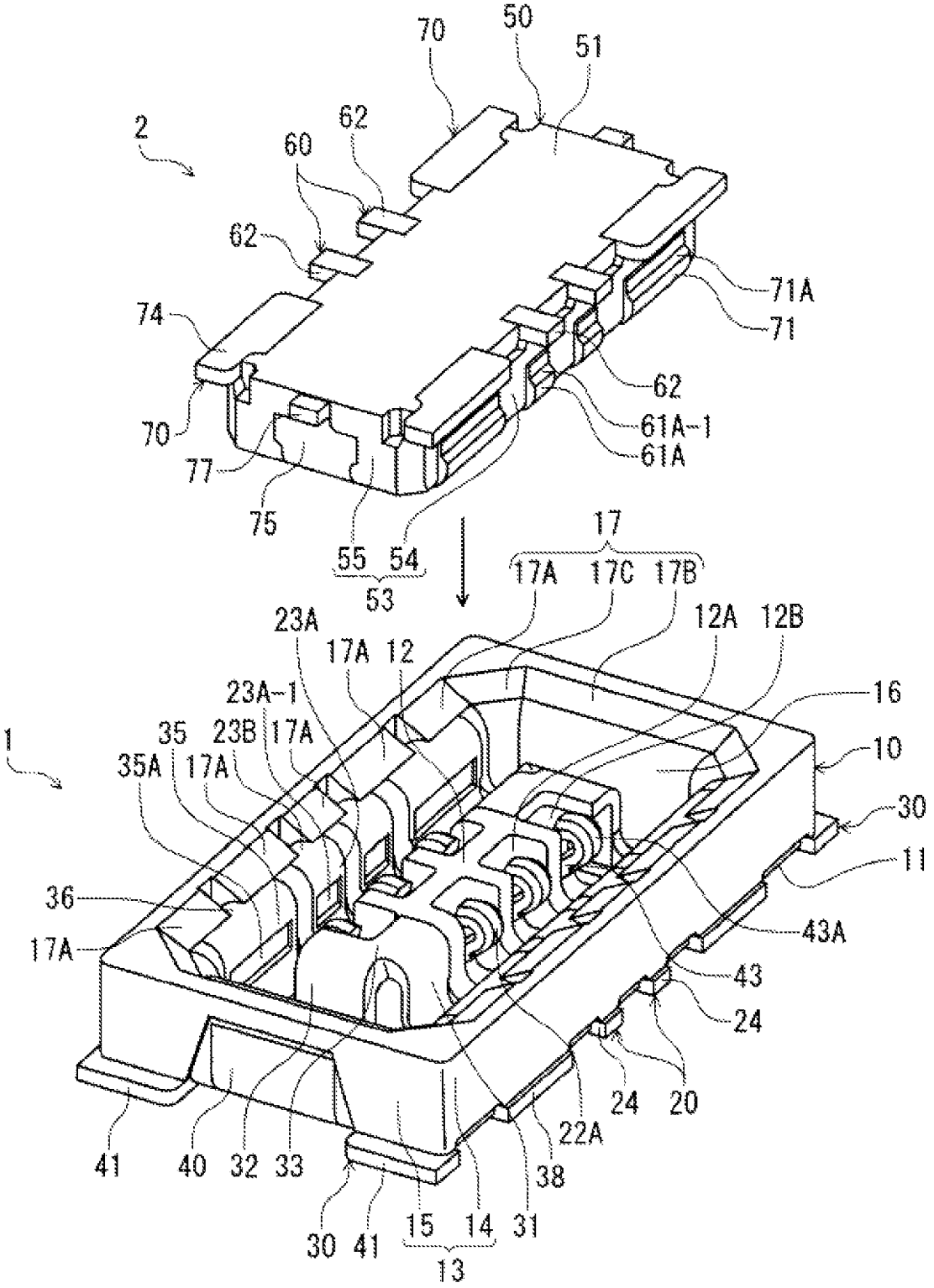
FIG. 1

An oblique view illustrating the receptacle connector and plug connector of FIG. 1 with the housing omitted.

FIG. 3

An oblique view illustrating the receptacle lock fittings of the receptacle connector and the plug lock fittings of the plug connector of FIG. 1.

FIGS. 4(A)-4(C)

Figure 4A:
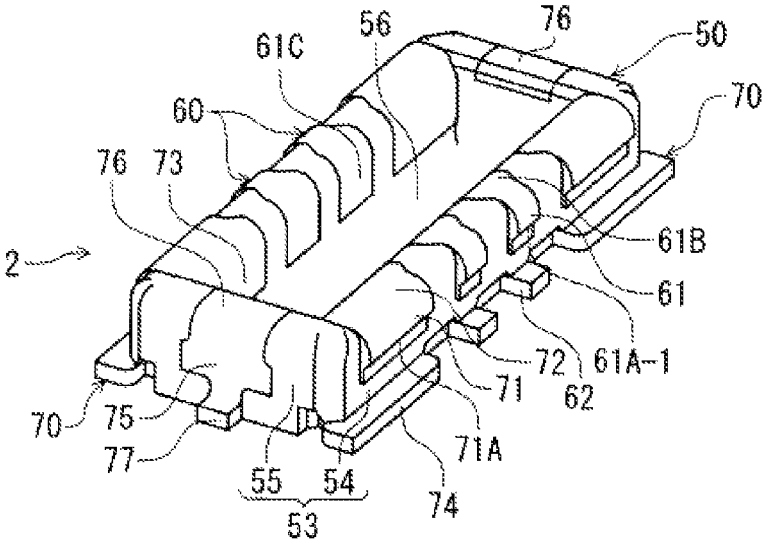
Figure 4B:
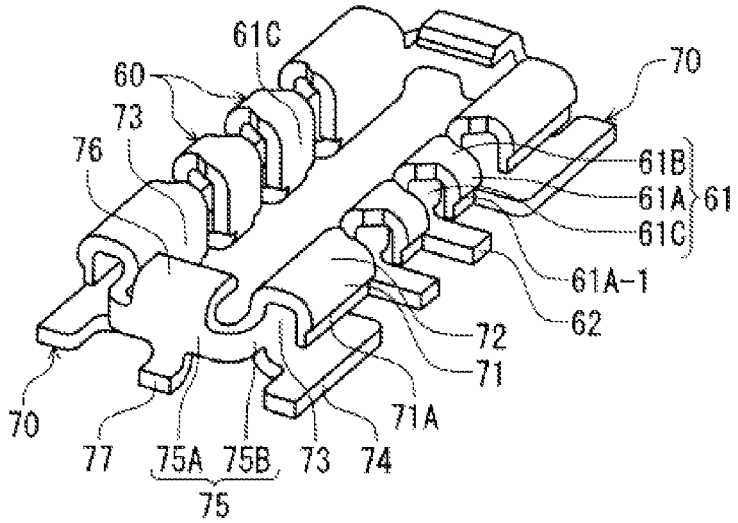
Figure 4C:
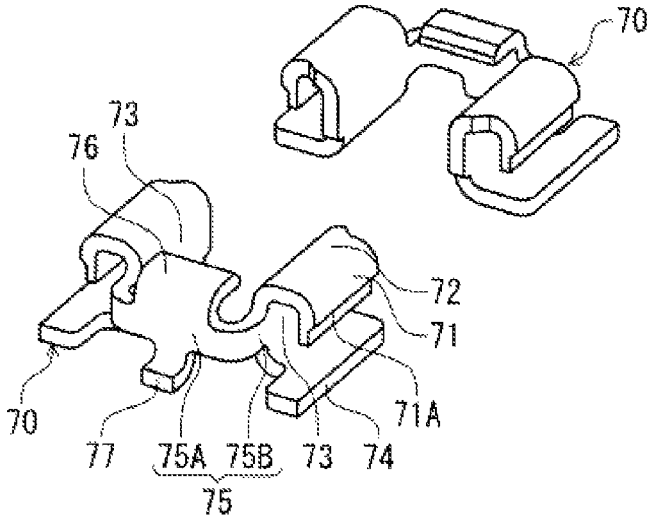

FIG. 4(A) is an oblique view illustrating the plug connector of FIG. 1 after turning it over, FIG. 4 (B) is an oblique view illustrating the plug connector of FIG. 4 (A) with the housing omitted, and FIG. 4 (C) is an oblique view illustrating only the plug lock fittings of the plug connector of FIG. 4 (A).

FIG. 5

A cross-sectional view taken in a plane perpendicular to the array direction of the receptacle connector and plug connector of FIG. 1, illustrating a cross-section taken through the lock fittings in the above-mentioned array direction.

FIGS. 6(A)-6(B)

Figure 6A:
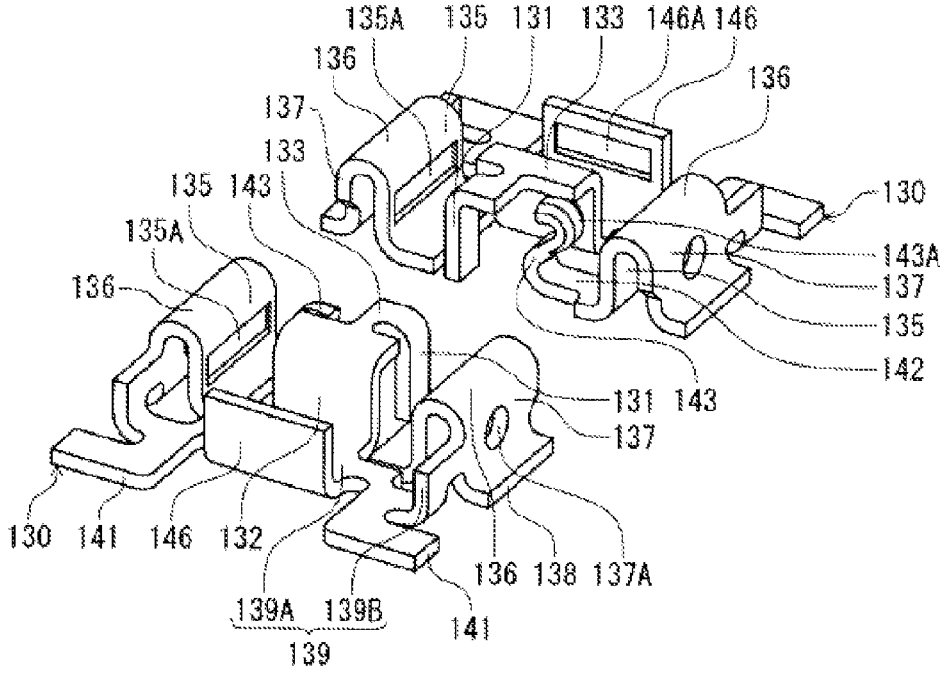
Figure 6B:
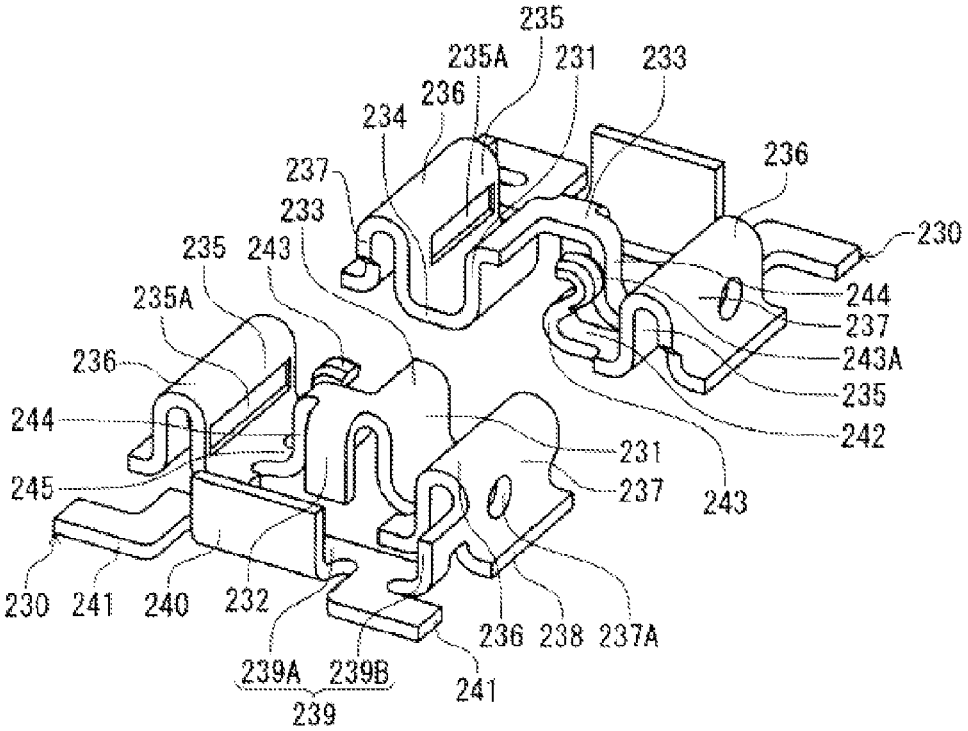

FIG. 6 (A) is an oblique view illustrating receptacle lock fittings according to a second embodiment and FIG. 6 (B) is an oblique view illustrating receptacle lock fittings according to a third embodiment.

DETAILED DESCRIPTION

First Embodiment

FIG. 1 is an oblique view of a receptacle connector 1 and a plug connector 2 mated therewith from above according to a first embodiment of the present invention, illustrating a state prior to connector mating. The receptacle connector 1 and plug connector 2 according to the present embodiment, which are electrical connectors for circuit boards disposed on the mounting faces of respective different circuit boards (not shown), form a connector assembly, wherein the direction of insertion and extraction is a direction perpendicular to the mounting faces of the circuit boards (vertical direction in FIG. 1). In the discussion of this embodiment, the direction of mating of the plug connector 2 with the receptacle connector 1, that is, the direction of downward movement of the plug connector 2 in FIG. 1, is described as the "direction of connector mating", while the opposite direction, in other words, the upwardly-facing direction of FIG. 1, is described as the "direction of connector extraction". In addition, the direction of extraction and the direction of mating of the receptacle connector 1, which serves as a mating connector for the plug connector 2, are directions respectively opposite to the "direction of connector mating" and the "direction of connector extraction" of the above-mentioned plug connector 2.

[Configuration of Receptacle Connector 1]

As seen in FIG. 1, the receptacle connector 1 has a housing 10, which has a substantially rectangular parallelepiped-like external configuration, receptacle lock fittings 30, and multiple receptacle signal terminals 20 (hereinafter referred to simply as "receptacle terminals 20") retained in an array form by means of unitary co-molding with said housing 10 such that the direction of the array is the longitudinal direction of the housing 10 parallel to the above-mentioned mounting face. The term "array" in above-mentioned term "array direction" simply refers to the fact that the receptacle terminals 20 and receptacle lock fittings 30 are provided at different locations with respect to one another in the above-mentioned longitudinal direction when the receptacle connector 1 is viewed in the transverse direction of the housing 10, and it is not required that the receptacle terminals 20 and receptacle lock fittings 30 be disposed at the same locations when the receptacle connector 1 is viewed in the above-mentioned longitudinal direction.

As seen in FIG. 1, the receptacle terminals 20 are provided in a region in the vicinity of the center of the housing 10 in the above-mentioned array direction such that they form two symmetrical rows in the connector width direction, with two terminals arranged in each row. In addition, the receptacle lock fittings 30 are provided at the end portions of the housing 10 at two external locations relative to the array region of the receptacle terminals 20 in the above-mentioned array direction. The receptacle connector 1 is disposed and mounted on a circuit board in the orientation illustrated in FIG. 1.

As seen in FIG. 1, the housing 10 is made of resin or another electrically insulating material and has a bottom wall 11, which has a bottom face parallel to the mounting face of the circuit board (not shown) that serves as a mounting surface and which extends such that the above-mentioned array direction is its longitudinal direction, a protruding wall 12, which rises up from the bottom wall 11 while extending in the above-mentioned array direction, and a perimeter wall 13, which rises up from the bottom wall 11 and surrounds the protruding wall 12. Said perimeter wall 13 has two lateral walls 14, which are in a mutually opposing relationship and extend in the above-mentioned array direction, and two end walls 15, which couple the end portions of said two lateral walls 14 and extend in the connector width direction (transverse direction of the housing 10) perpendicular to the above-mentioned array direction. An upwardly open quadrangular annular space between the perimeter wall 13 and the protruding wall 12 forms a receiving portion 16 used to receive a mating portion of the plug connector 2.

The protruding wall 12 has formed therethrough signal groove portions 12A at locations corresponding to the receptacle terminals 20 in the above-mentioned array direction, and, in addition, power supply groove portions 12B at locations corresponding to the hereinafter described contact arm portions provided in the receptacle lock fittings 30, with said portions being sunken into the lateral faces of the protruding wall 12 (faces perpendicular to the connector width direction) and extending in the vertical direction (in addition, see power supply groove portions 12B in FIG. 5). As seen in FIG. 1, the signal groove portions 12A are formed in the lateral faces on both sides of the protruding wall 12 and the power supply groove portions 12B are formed in the lateral faces on one side of the protruding wall 12. In addition, the power supply groove portion 12B provided at one end of the protruding wall 12 in the above-mentioned array direction and the power supply groove portion 12B provided at the other end are formed in mutually opposed lateral faces. The signal groove portions 12A contain the hereinafter described signal contact arm portions 22 of the receptacle terminals 20, while the hereinafter described power supply contact arm portions 43 of the receptacle lock fittings 30 are contained in the power supply groove portions 12B.

Guide faces 17, which slope downwardly toward the receiving portion 16, are formed in the top portion of the inner surface (surface located proximate to the receiving portion 16) of the perimeter wall 13. Said guide faces 17 have lateral guide faces 17A, which are formed on the inner surface of the lateral walls 14, end guide faces 17B, which are formed on the inner surface of the end walls 15, and corner guide faces 17C, which are formed on the inner surface of the interfacing sections between the lateral walls 14 and end walls 15. As seen in FIG. 1, the lateral guide faces 17A are formed in an intermittent manner at multiple locations on the lateral walls 14 in above-mentioned array direction. The end guide faces 17B are formed as a single surface extending in the connector width direction of the end walls 15. The corner guide faces 17C couple the above-mentioned end guide faces 17B and the lateral guide faces 17A at the outermost locations in the above-mentioned array direction.

Figure 2:
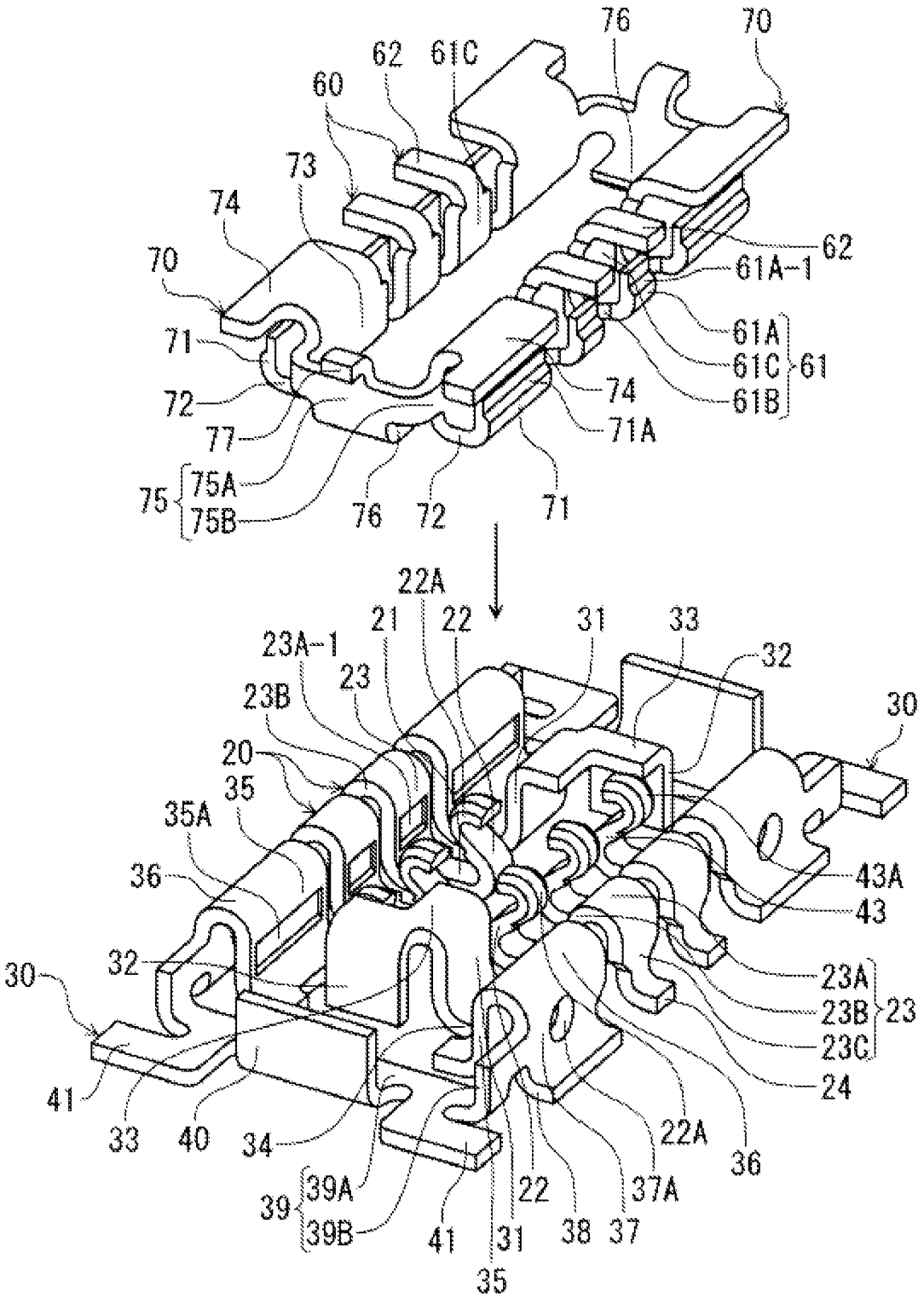

FIG. 2 is an oblique view illustrating the receptacle connector 1 and plug connector 2 of FIG. 1 with the housing 10 omitted. The configuration of the receptacle terminals 20 will be described hereinbelow with reference to FIG. 1 and FIG. 2. A receptacle terminal 20 has a bottom base portion 21, which is made by bending a strip-shaped sheet metal piece in the sheet thickness direction and extends in the connector width direction along the bottom wall 11 of the housing, a signal contact arm portion 22, which extends upwardly from the end portion of said bottom base portion 21 proximate to the protruding wall 12, an inverted U-shaped retained portion 23, which first extends upwardly at the end portion of the bottom base portion 21 proximate to the lateral wall 14 and then folds back downwardly, and a connecting portion 24, which extends outwardly in the connector width direction from the lower end of said retained portion 23.

The bottom base portion 21, which extends across a range that includes the receiving portion 16 in the connector width direction, is retained in place by unitary co-molding with the bottom wall 11, with the upper surface of said bottom base portion 21 exposed to the receiving portion 16. The signal contact arm portions 22 are contained in the signal groove portions 12A of the protruding wall 12 and are elastically displaceable in their sheet thickness direction (connector width direction). Said signal contact arm portions 22 have their upper end sections, i.e. their free ends, convex-curved towards the lateral wall 14, and these convex-curved sections are formed as signal contact protrusions 22A used to provide contact with the plug terminals 60 of the hereinafter described plug connector 2. In a free state, the curved top portions of the signal contact protrusions 22A of the signal contact arm portions 22 protrude from the signal groove portions 12A of the housing 10 and are located inside the receiving portion 16.

The retained portions 23 have internal arm portions 23A, which extend upwardly from the end portions of the base bottom portions 21 proximate to said lateral wall 14 along the inner surface of the lateral wall 14, transitional portions 23B, which continue from the upper end of said internal arm portions 23A and are folded back downwardly at a more external location in the connector width direction than said internal arm portions 23A, and external arm portions 23C, which extend downwardly via said transitional portions 23B, and are retained in place by unitary co-molding with the lateral walls 14. As seen in FIG. 1, the upper ends of said retained portions, in other words, the upper ends of the transitional portions 23B, are located at practically the same height as the lower edges of the lateral guide faces 17A in the vertical direction.

The internal arm portions 23A have their major surfaces exposed to the receiving portion 16, and locking recessed portions 23A-1 sunk into said major surfaces in a rectangular-shaped configuration are formed therein. Said locking recessed portions 23A-1 are formed, for example, by press-forming and the like, and their width dimensions (dimensions in the above-mentioned array direction) are smaller than the width dimensions of the internal arm portions 23A. As a result of engagement with lockable stepped portions 61A-1 in the plug terminals 60 of the hereinafter described plug connector 2, said locking recessed portions 23A-1 maintain the connectors in a mated state and prevent disengagement of the connectors while at the same time contacting and providing electrical communication during engagement with the lockable stepped portions 61A-1, thereby also serving to assist the above-mentioned signal contact protrusions 22A.

As seen in FIG. 1, a portion of the upper surface of the transitional portions is exposed between the lateral guide faces 17A. The external arm portions 23C are embedded and retained in the lateral walls 14 without being exposed on said lateral walls 14. In addition, as is best seen in FIG. 2, the width dimensions (dimensions in the above-mentioned array direction) of the bottom portions of said external arm portions 23C are smaller than the width dimensions of other portions.

As seen in FIG. 2, the connecting portions 24, which are at the same height level as the bottom base portions 21 and extend directly from the lower ends of the external arm portions 23C outwardly in the connector width direction up to almost the same position as the external surface of the lateral walls 14, are exposed on the bottom wall 11 of the housing 10. Said connecting portions 24 are solder-connected to the corresponding signal circuitry of the circuit board.

Figure 3:
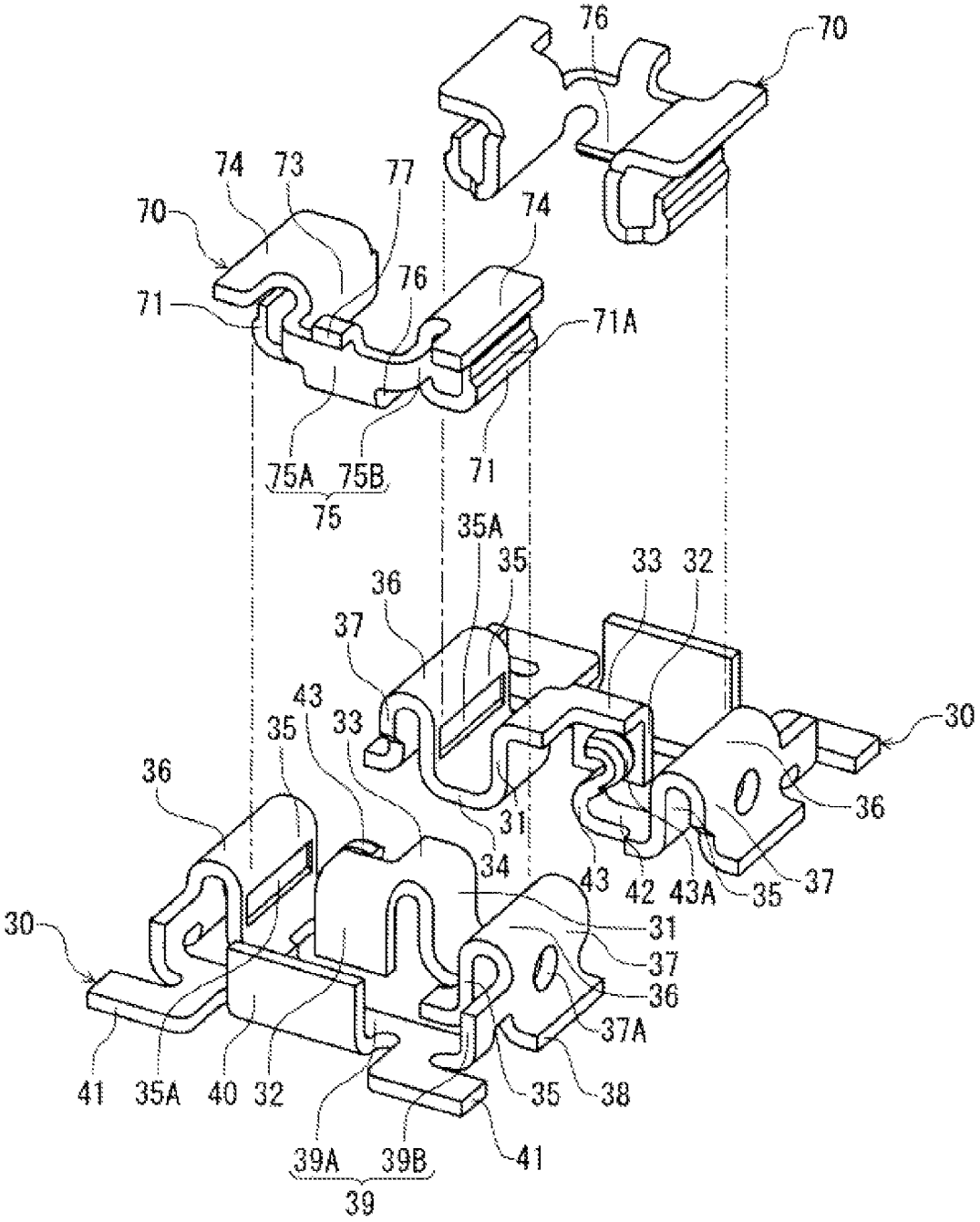

Next, the configuration of the receptacle lock fittings 30 will be described with reference to FIGS. 1-3. FIG. 3 is an oblique view illustrating the receptacle lock fittings 30 of the receptacle connector 1 of FIG. 1 and the plug lock fittings 70 of the plug connector 2. In this embodiment, the receptacle lock fittings 30 function not only as lock fittings, but also, as discussed below, possess a power supply terminal functionality. However, it is not essential for the receptacle lock fittings 30 to be provided with the power supply terminal functionality.

The receptacle lock fittings 30 are made by bending sheet metal members in the sheet thickness direction, and, when viewed from above, can be roughly divided into a section provided in the area of the protruding wall 12, sections provided in the respective areas of the two lateral walls 14, a section provided in the area of the end wall 15, and a section provided in the area of the receiving portion 16.

As seen in FIG. 1, the sections of the receptacle lock fittings 30 provided in the area of the protruding wall 12 have upright face-reinforcing lateral plate portions 31, which extend along a lateral face constituting an upright face of the protruding wall 12 (the face perpendicular to the connector width direction), upright face-reinforcing end plate portions 32, which extend along an end face constituting another upright face of the protruding wall 12 (the face perpendicular to the array direction), face-reinforcing top plate portions 33, which extend along the top face (upper surface) of the protruding wall 12, and power supply contact arm portions 43, which extend upwardly from the hereinafter-described extension portions 42 inside the power supply groove portions 12B of the protruding wall 12.

As seen in FIG. 1, when the top face of the end portions of the protruding wall 12 is viewed from above, the face-reinforcing top plate portions 33 extend in an L-shaped configuration in the region outside the power supply groove portions 12B on said top face, and, as seen in FIG. 1 and FIG. 2, couple the upper ends of the upright face-reinforcing lateral plate portions 31 and the upright face-reinforcing end plate portions 32. The upright face-reinforcing lateral plate portions 31, upright face-reinforcing end plate portions 32, and face-reinforcing top plate portions 33 have their major surfaces exposed, respectively, on the lateral faces, end faces, and top face of the protruding wall 12, and are retained in place on said protruding wall 12. Since in this embodiment the upright face-reinforcing lateral plate portions 31, upright face-reinforcing end plate portions 32, and face-reinforcing top plate portions 33 respectively cover the lateral faces, end faces, and top face of the protruding wall 12, the lateral faces, end faces, and top face of the protruding wall 12 can be protected from damage due to interference with the plug connector in the process of connector insertion and extraction.

The power supply contact arm portions 43 are positioned to be aligned with the signal contact arm portions 22 of the receptacle terminals 20, and can be brought into contact with internal plate portions 73A (see FIG. 4 (A)-(C)) provided in the hereinafter-described plug lock fitting 70 and serve as corresponding power supply contact portions under a contact pressure as a result of elastic displacement in the sheet thickness direction (connector width direction). Said power supply contact arm portions 43 have their upper end sections, i.e. their free ends, convex-curved towards the lateral walls 14, and are formed as power supply contact protrusions 43A used to provide contact between the convex-curved sections and the above-mentioned internal plate portions 73. In a free state, the curved top portions of the power supply contact protrusions 43A of the power supply contact arm portions 43 protrude from the power supply groove portions 12B of the housing 10 and are located inside the receiving portion 16. It should be noted that when the receptacle lock fittings 30 are not provided with power supply terminal functionality, the power supply contact arm portions 43 are omitted.

The sections of the receptacle lock fitting 30 provided in the areas of the lateral walls 14 have lock plate portions 35, which extend along the inner surface of said lateral walls 14, transitional portions 36, which fold back downwardly from the upper end of said lock plate portions 35, lateral retained portions 37, which extend downwardly via said transitional portions 36 and through the lateral walls 14, and lateral securing portions 38, which extend outwardly in the connector width direction from the lower edge of said lateral retained portions 37. The lock plate portions 35 are retained in place on said lateral walls 14, with their major surfaces located proximate to the receiving portion 16 exposed on the inner surfaces of the lateral walls 14, and locking recessed portions 35A, which are sunk into their exposed major surfaces in a rectangular configuration, are formed therein.

The transitional portions 36 are upwardly convex-curved and, as seen in FIG. 1, a portion of their upper surface is exposed between the lateral guide faces 17A. As seen in FIG. 2, the lateral retained portions 37 have an opening 37A formed therethrough in the sheet thickness direction, and, as a result of resin flowing into said openings 37A during unitary co-molding with the housing 10, the housing 10 can retain the receptacle lock fittings 30 more securely. The lateral retained portions 37 are embedded and retained in the lateral walls 14 without being exposed on said lateral walls 14.

As seen in FIG. 1, the lateral securing portions 38 are exposed on the bottom wall 11 of the housing 10 and are secured by solder-connecting their lower surfaces to the corresponding power supply circuitry of the circuit board. Said lateral securing portions 38 extend in the connector width direction up to almost the same position as the external surface of the lateral walls 14.

The sections of the receptacle lock fittings 30 provided in the area of the end walls 15 have coupling portions 39, which extend in the connector width direction and couple the side edge portions (the edge portions extending in the vertical direction) of the lateral retained portions 37, end retained portions 40, which extend upwardly along the external surface of the end walls 15 from said coupling portions 39 at intermediate locations between said coupling portions 39 in the connector width direction, and end securing portions 41, which extend outwardly in the array direction from said coupling portions 39 and then outwardly in the connector width direction at locations in the vicinity of the two ends of the coupling portions 39 in the connector width direction.

The coupling portions 39 have coupling base portions 39A, which have major surfaces perpendicular to the vertical direction and which extend in the connector width direction, and coupling end portions 39B, which are bent and extend upwardly at both ends of said coupling base portions 39A.

The base portions 39A extend along the bottom wall 11 and are retained in place on said bottom wall 11. The coupling end portions 39B, which are provided at the same locations in the connector width direction as the lateral retained portions 37, are embedded and retained in the lateral walls 14 without being exposed on said lateral walls 14. Although in this embodiment the coupling portions 39 couple the lateral retained portions 37, they may be used instead, for example, to couple the lock plate portions 35.

Of the two side edge portions (edge portions extending in the connector width direction) of the coupling base portions 39A, the end retained portions 40 extend upwardly from the side edge portion that is located on the outside in the above-mentioned array direction. The end retained portions 40 have their major surfaces exposed on the external surfaces of the end walls 15 and retained in place on said end walls 15. The end securing portions 41, which are located at the two lateral positions of the end retained portions 40, extend outwardly in the above-mentioned array direction from the side edge portions of the coupling base portions 39A located on the outside in the above-mentioned array direction and then extend outwardly in the connector width direction, and have an L-shaped configuration when viewed from above. As seen in FIG. 1, the end securing portions 41 are exposed on the bottom wall 11 of the housing 10 and are secured by solder-connecting their lower surfaces to the corresponding portions of the circuit board. Said end securing portions 41 extend in the connector width direction up to almost the same position as the external surface of the lateral walls 14.

The sections of the receptacle lock fittings 30 provided in the area of the receiving portion 16 have connecting bottom portions 34 that connect the lower end portions of the upright face-reinforcing lateral plate portions 31 and the lock plate portions 35 on one side facing said upright face-reinforcing lateral plate portions 31, and extension portions 42 that connect the lower end portions of the power supply contact arm portions 43 and the lock plate portions 35 on the other side facing said power supply arm portions 43. The connecting bottom portions 34 and extension portions 42 extend along the bottom wall 11 in the connector width direction and are retained in place on said bottom wall 11 with their upper surfaces exposed to the receiving portion 16. The extension portions 42 extend from the lower edge of the lock plate portions 35 towards the protruding wall 12 at the same location as the power supply groove portions 12B of the protruding wall 12 in the above-mentioned array direction. It should be noted that when the receptacle lock fittings 30 are not provided with power supply terminal functionality, the extension portions 42 may be omitted.

[Configuration of Plug Connector 2]

Next, the configuration of plug connector 2 will be described with reference to FIGS. 1-4 (A-C). FIG. 4 (A) is an oblique view illustrating the plug connector 2 of FIG. 1 after turning it over, FIG. 4 (B) is an oblique view illustrating the plug connector 2 of FIG. 4 (A) with its housing 50 omitted, and FIG. 4 (C) is an oblique view illustrating only the plug lock fittings 70 of the plug connector 2 of FIG. 4 (A).

The plug connector 2 has a frame-shaped mating portion adapted for the receiving portion 16 of the receptacle connector 1 (see FIG. 4 (A)) and the connectors 1 and 2 are configured to be mated by nesting said mating portion into the receiving portion 16. The plug connector 2 has a housing 50 with a substantially rectangular parallelepiped-like external configuration, plug lock fittings 70, and multiple plug signal terminals 60 (hereinafter referred to simply as "plug terminals 60") retained in an array form on said housing 50 by unitary co-molding therewith such that the array direction is the longitudinal direction of the housing 50 parallel to the mounting face of the circuit board (not shown).

The housing 50 is made from resin or another electrically insulating material and, as seen in FIG. 1, has a bottom wall 51, which has a bottom face parallel to the mounting face of the circuit board (not shown), which serves as a mounting surface and which extends such that the above-mentioned array direction is the longitudinal direction, and a perimeter wall 53, which serves as a mating portion and protrudes downwardly (upwardly in FIG. 4 (A)) from said bottom wall 51. Said perimeter wall 53 has two lateral walls 54, which are in a mutually opposing relationship and extend in the above-mentioned array direction, and two end walls 55, which couple the end portions of said two lateral walls 54 and extend in the connector width direction (transverse direction of the housing 50) perpendicular to the above-mentioned array direction. The space that is surrounded by the perimeter wall 53 and is open downwardly in FIG. 1 (upwardly in FIG. 4 (A)) forms a receiving portion 56 (see FIG. 4 (A)) used to receive the protruding wall 12 of the receptacle connector 1.

The plug terminals 60 are provided in a region in the vicinity of the center of the housing 50 in the above-mentioned array direction such that they form two symmetrical rows in the connector width direction, with two terminals arranged in each row. Said plug terminals 60 are made by bending strip-shaped sheet metal pieces in the sheet thickness direction and, as best seen in FIG. 2 and FIG. 4 (B), have U-shaped U-portions 61, which are retained in place on the lateral walls 54, and connecting portions 62, which extend outwardly in the connector width direction from the upper end in FIG. 2 (lower end in FIG. 4 (B)) of the arm portion on one side (hereinafter described internal arm portion 61C) located proximate to the receiving portion 56 (of the two arm portions of said U-portions 61) and are connected to the corresponding signal circuitry of the circuit board. The plug terminals 60 are retained in place on the U-portions 61 as a result of unitary co-molding with the housing 50.

The U-portions 61, which are portions that are inserted between the internal arm portions 23A and the signal contact arm portions 22 of the receptacle terminals 20 of the receptacle connector 1 when the connectors are in a mated state, are embedded in said lateral walls 54 so as to stride the lateral walls 54 from below (above in FIG. 4 (A, B)). As is best seen in FIG. 1 and FIG. 2, said U-portions 61 have external arm portions 61A, which extend downwardly along the external surface of the lateral walls 54, transitional portions 61B, which are folded back upwardly from the lower ends of said external arm portions 61A at internal locations in the connector width direction, and internal arm portions 61C that extend upwardly through said transitional portions 61B. The dimensions of the U-portions 61 in the connector width direction are slightly larger than the spacing between the signal contact protrusions 22A of the receptacle terminals 20 and the major surfaces of the internal arm portions 23A facing said signal contact protrusions 22A.

As seen in FIG. 1, the external arm portions 61A of the U-portions 61 have their major surfaces exposed on the external surfaces of the lateral walls 54. On the exposed major surfaces, there are formed lockable stepped portions 61A-1, which have a stepped shape formed therein by sinking into the top portion of said major surfaces and which extend in the width direction (above-mentioned array direction) of said external arm portions 61A, and said lockable stepped portions 61A-1 are adapted to engage with the locking recessed portions 23A-1 of the receptacle terminals 20. As seen in FIG. 2, the transitional portions 61B extend in the connector width direction, with the lower surface (upper surface in FIG. 4 (A))

of said transitional portions 61B being exposed on the lateral walls 54. As seen in FIG. 4 (A), the internal arm portions 61C have their major surfaces proximate to the receiving portion 56 exposed on the inner surfaces of the lateral walls 54, and the exposed major surfaces are formed as corresponding signal contact portions that contact the signal contact protrusions 22A of the receptacle terminals 20 under a contact pressure when the connectors are in a mated state.

As seen in FIG. 2, the connecting portions 62, which extend directly from the upper ends of the internal arm portions 61C along the bottom face of the bottom wall 51 and outwardly in the connector width direction and protrude out of the housing 50 (also see FIG. 1), are solder-connectable to the corresponding signal circuitry of the circuit board.

As seen in FIG. 2 and FIG. 4 (A), one plug lock fitting 70 is provided at each end portion of the housing 10 in the above-mentioned array direction to match the receptacle lock fittings 30 of the receptacle connector 1. In addition to the locking feature that enables locking with the receptacle lock fittings 30, said plug lock fittings 70 also possess power supply terminal functionality for contacting and providing electrical communication with the power supply contact arm portions 43 of said receptacle lock fittings 30. However, it is not essential for the plug lock fittings 70 to be provided with power supply terminal functionality.

The plug lock fittings 70 are made by bending sheet metal members in the sheet thickness direction and, as shown in FIG. 1 and FIG. 2, have external plate portions 71, which extend along the external surface of the lateral walls 54 of the housing 50, transitional portions 72, which extend inwardly in the connector width direction from the lower ends of said external plate portions 71, internal plate portions 73, which extend upwardly via said transitional portions 72 along the inner surface of the lateral walls 54, lateral securing portions 74, which extend outwardly in the connector width direction from the upper ends of said internal plate portions 73, coupling portions 75, which extend in the connector width direction and couple the two internal plate portions 73, end retained portions 76, which extend inwardly in the array direction from the lower edge of the coupling portions 75, and end securing portions 77, which extend outwardly in the array direction from the upper edge of coupling portions 75.

As seen in FIG. 1, the external plate portions 71 have their major surfaces exposed on the external surfaces of the lateral walls 54 and, on the exposed major surfaces, there are formed lockable stepped portions 71A, which have a stepped shape formed therein by sinking into the top portion of said major surfaces and which extend in the width direction (above-mentioned array direction) of said external plate portions 71. Said lockable stepped portions 71A are formed at the same height level as the lockable stepped portions 61A-1 of the external arm portions 61A of the plug terminals 60. Said lockable stepped portions 71A are adapted to lock with the locking recessed portions 35A of the receptacle lock fittings 30 when the connector is mated with the receptacle connector 1.

The transitional portions 72 extend in the connector width direction along the lower surface (upper surface in FIG. 4 (A)) of the lateral walls 54, with the lower surface (upper surface in FIG. 4 (A)) of said transitional portions 72 being exposed on the lateral walls 54 (see FIG. 4 (A)). The major surfaces of the internal plate portions 73 are exposed on the inner surfaces of the lateral walls 54. In this embodiment, of the two internal plate portions 73 provided in the plug lock fittings 30, the internal plate portion 73 located corresponding to the power supply contact arm portion 43 of the receptacle lock fittings 30 is formed as the corresponding power supply contact portion contacting said power supply contact arm portion 43 under a contact pressure.

The lateral securing portions 74 which, as seen in FIG. 2, extend outwardly in the connector width direction from the upper ends (lower ends in FIG. 4 (A)-(C)) of the internal plate portions 73, and, as seen in FIG. 1, protrude out of the housing 50, are solder-connectable to the corresponding circuitry of the circuit board. In addition, as seen in FIG. 2, said lateral securing portions 74 extend to reach more external locations in the above-mentioned array direction than the internal plate portions 73, which ensures a considerable increase in the mounting surface area that is solder-connectable to the above-mentioned corresponding circuitry.

As seen in FIG. 2, the coupling portions 75 have coupling base portions 75A, which have major surfaces perpendicular to the above-mentioned array direction and extend in the connector width direction, and coupling end portions 75B, which are bent at both ends of said coupling base portions 75A and extend inwardly in the above-mentioned array direction. Said coupling portions 75 are retained in place on the end walls 55 and, as seen in FIG. 1, their major surfaces in the central area in the connector width direction are exposed on the external surfaces of the end walls 55.

The end retained portions 76 are retained in place on the end walls 55 and, as seen in FIG. 4 (A), have their major surfaces exposed on the upper surface (lower surface in FIG. 1) of the end walls 55. As seen in FIG. 1, the end securing portions 77 protrude in the above-mentioned array direction from the bottom wall 51 of the housing 50 and are secured by solder-connecting their upper surfaces (lower surfaces in FIG. 4(A)) to the corresponding portions of the circuit board.

[Connector Mating Operation]

Next, the operation of mating the connectors 1, 2 will the described with reference to FIG. 1 and FIG. 5. FIG. 5 is a cross-sectional view taken in a plane perpendicular to the array direction of the receptacle connector 1 and plug connector 2 of FIG. 1, illustrating a cross-section taken through the lock fittings 30, 70 in the above-mentioned array direction.

First, the receptacle connector 1 is mounted on the circuit board by respectively solder-connecting the connecting portions 24 of the receptacle terminals 20 of the receptacle connector 1 and the lateral securing portions 38 of the receptacle lock fittings 30 to the corresponding circuitry of the circuit board while at the same time solder-connecting the end securing portions 41 of the receptacle lock fittings 30 to the corresponding portions of the circuit board. In addition, the plug connector 2 is mounted on the other circuit board by respectively solder-connecting the connecting portions 62 of the plug terminals 60 of the plug connector 2 and the lateral securing portions 74 of the plug lock fittings 70 to the corresponding circuitry of the above-mentioned other circuit board while at the same time solder-connecting the end securing portions 77 of the plug lock fittings 70 to the above-mentioned corresponding portions of the other circuit board.

Figure 5:
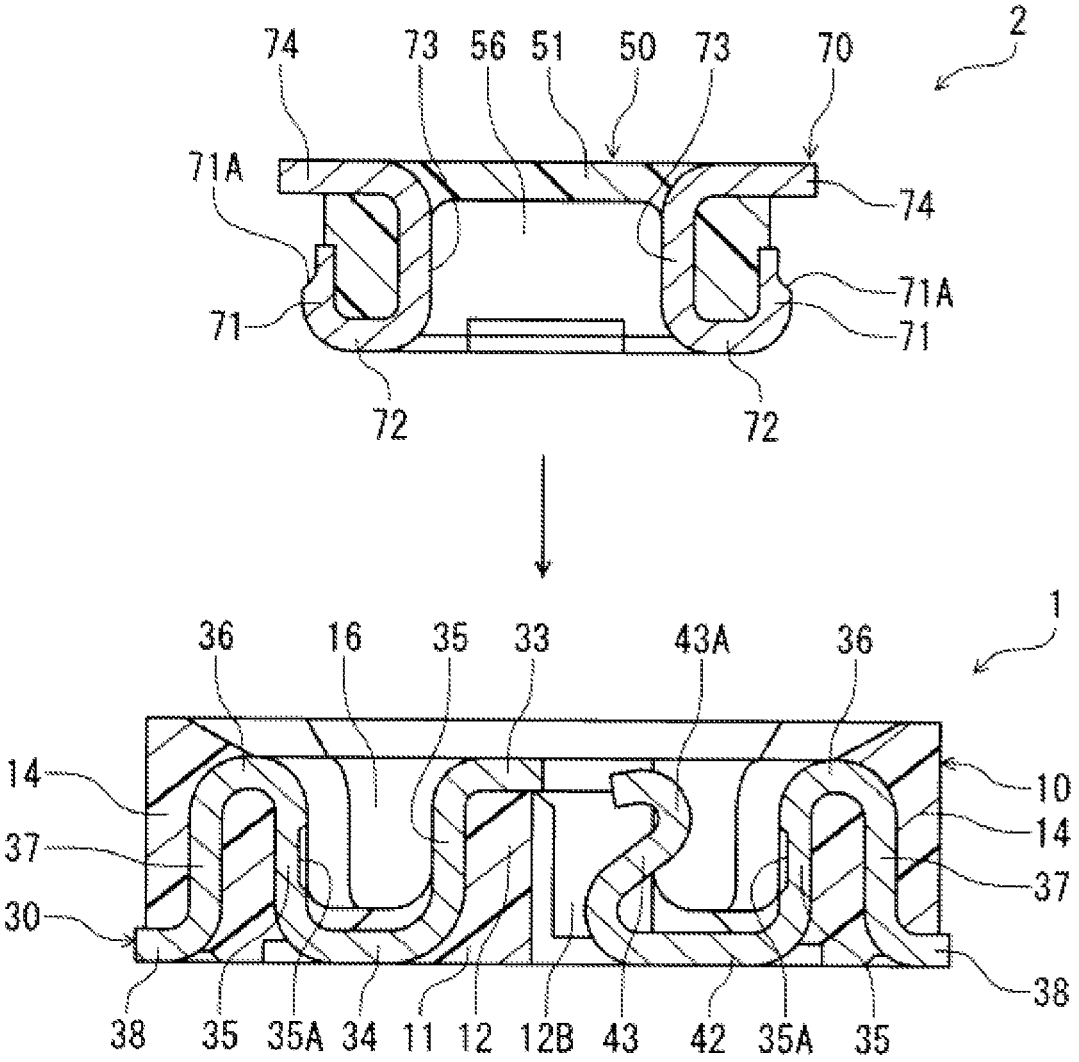

Next, as seen in FIG. 1 and FIG. 5, the receptacle connector 1 is brought into an orientation in which the receiving portion 16 is upwardly open while at the same time bringing the plug connector 2 into an orientation in which the receiving portion 56 is downwardly open and placing it above said receptacle connector 1. Subsequently, as shown by arrows in FIG. 1 and FIG. 5, the plug connector 2 is moved downwardly and the mating portion of said plug connector 2 is nested inside the receiving portion 16 of the receptacle connector 1.

As a result, the U-portions 61 of the plug terminals 60 of the plug connector 2 are inserted between the locking recessed portions 23A-1 and the signal contact protrusions 22A of the receptacle terminals 20 of the receptacle connector 1 by pushing and expanding the gaps. Subsequently, the signal contact arm portions 22 undergo elastic displacement inwardly in the connector width direction. Furthermore, when the insertion of the U-portions 61 takes place and the connectors are in a mated state, the signal contact protrusions 22A are brought into contact with the internal arm portions 61C (corresponding signal contact portions) of the U-portions 61 under a contact pressure and, at the same time, the lockable stepped portions 61A-1 of the external arm portions 61A of the U-portions 61 are inserted into the locking recessed portions 23A-1 and are positioned engageably with the upper edges of said locking recessed portions 23A-1 in the direction of connector extraction. As a result, the terminals 20, 60 of the connectors 1, 2 are locked to each other while being in electrical communication.

In addition, under a contact pressure, the power supply contact protrusions 43A are brought into contact with the internal plate portions 73 (corresponding power supply contact portions) of the plug lock fittings 70 located corresponding to said power supply contact arm portions 43. In addition, when the connectors are in a mated state, the lockable stepped portions 71A of the plug lock fittings 70 are inserted into the locking recessed portions 35A of the receptacle lock fittings 30 and are positioned engageably with the upper edges of said locking recessed portions 35A in the direction of connector extraction. As a result, the lock fittings 30, 70 are locked to each other while being in electrical communication. This completes the operation of mating of the connectors 1 and 2.

In this embodiment, the lock plate portions 35 do not undergo elastic displacement before or after connector mating because the lock plate portions 35 of the receptacle lock fittings 30 are retained in place on the lateral walls 14 of the housing 10. Accordingly, even if an excessive extraction force inadvertently acts on the plug connector 2 in the direction of connector extraction, the lock plate portions 35 do not get deformed or damaged. As a result, the locked state is maintained and inadvertent removal of the plug connector 2 is prevented.

In addition, in this embodiment, the lateral retained portions 37 retained in place on the lateral walls 14 are coupled to the lock plate portions 35 via the transitional portions 36. Therefore, the number of locations of the lock fittings 30 retained on the lateral walls 14 increases proportionately to said lateral retained portions 37 and said transitional portions 36, and inadvertent extraction forces can be resisted with an even greater force, thereby making it possible to more reliably prevent deformation and damage to the lock plate portions 35.

Furthermore, the lock plate portions 35 are connected to the upright face-reinforcing lateral plate portions 31 retained on the protruding wall 12 of the housing 10 via the connecting bottom portions 34, such that the upright face-reinforcing lateral plate portions 31 and lock plate portions 35 provide mutual reinforcement. Accordingly, even if an excessive extraction force inadvertently acts on the plug connector 2, the lock plate portions 35 will be able to resist it with a force greater than the above-mentioned extraction force, thereby making it possible to prevent deformation and damage to the lock plate portions 35.

In addition, in this embodiment, not only the upright face-reinforcing lateral plate portions 31, but also the face-reinforcing top plate portions 33 coupled to said upright face-reinforcing lateral plate portions 31 and the upright face-reinforcing end plate portions 32 coupled to said face-reinforcing top plate portions 33 are retained on the protruding wall 12. Therefore, since the number of locations of the lock fittings 30 retained on the protruding wall 12 increases proportionately to said face-reinforcing top plate portions 33 and upright face-reinforcing end plate portions 32, inadvertent extraction forces can be resisted with an even greater force, thereby making it possible to more reliably prevent deformation and damage to the lock plate portions 35.

Second Embodiment

While in the receptacle lock fittings 30 of the first embodiment the lock plate portions 35 and the upright face-reinforcing lateral plate portions 31 were connected via the connecting bottom portions 34, the second embodiment differs from the first embodiment in that the lock plate portions and the upright face-reinforcing end plate portions are connected via the connecting bottom portions.

FIG. 6 (A) is an oblique view illustrating receptacle lock fittings 130 according to the second embodiment. Below, the second embodiment will be described with reference to FIG. 6 (A). In this embodiment, the explanations will focus on the sections different from the first embodiment while sections identical to the first embodiment will be assigned numerals obtained by adding "100" to the numerals used in the first embodiment and the corresponding explanations will be omitted.

As seen in FIG. 6 (A), in addition to the lock plate portions 135 (hereinafter referred to as "lateral lock plate portions 135"), which are retained in place on the lateral walls of the housing (not shown), the receptacle lock fittings 130 of the present embodiment have lock plate portions 146 retained in place on the end walls (hereinafter referred to as "end lock plate portions 146").

The end lock plate portions 146, which extend upwardly from the side edge portions located on the outside in the array direction of the two side edge portions (side edge portions extending in the connector width direction) of the coupling base portions 139A of the coupling portions 139, have their major surfaces retained in place on said end walls while being exposed to the receiving portion on the inner surface of the end walls. On the exposed major surfaces of said end lock plate portions 146, there are formed locking recessed portions 146A sunk into said major surfaces in a rectangular configuration. When the connectors are in a mated state, as a result of receiving lockable stepped portions formed in the plug lock fittings corresponding to said locking recessed portions 146A, said locking recessed portions 146A are brought into a locked state engageable with said lockable stepped portions.

In addition, in this embodiment, as previously discussed, the end lock plate portions 146 also possess functionality to serve as end retained portions retained in place on the end walls. As seen in FIG. 6 (A), with the exception of the two end portions in the connector width direction (sections coupled with the coupling end portions 139B), the coupling base portions 139A of the coupling portions 139 are located more inwardly in the array direction than said coupling end portions 139B. Accordingly, the end lock plate portions 146 that stand upright from the side edge portions on the outside of the coupling base portions 139A in the above-mentioned array direction are provided at the same locations as the inner surfaces of the end walls in the above-mentioned array direction. Said end lock plate portions 146 are retained in place such that their major surfaces are exposed on the inner surfaces of the end walls, and this is the point of difference from the end retained portions 40 of the first embodiment, which are retained so as to be exposed on the external surfaces of the end walls.

In this embodiment, as seen in FIG. 6 (A), the lower ends of the upright face-reinforcing end plate portions 132 are connected to the side edge portions of the coupling base portions 139A of the coupling portions 139 located inwardly in the above-mentioned array direction. In other words, the coupling base portions 139A possess functionality to serve as connecting bottom portions and connect the lower end portions of the end lock plate portions 146 and the upright face-reinforcing end plate portion 132. Thus, the end lock plate portions 146 and the upright face-reinforcing end plate portion 132 are connected, thereby establishing a relationship of mutual reinforcement between the two. Therefore, even if an excessive extraction force inadvertently acts on the plug connector when the connectors are in a mated state, the end lock plate portions 146 will be able to resist it with a force greater than the above-mentioned extraction force, thereby making it possible to prevent deformation and damage to the end lock plate portions 146.

Furthermore, since the receptacle lock fittings 130 of the present embodiment have the end lock plate portions 146 in addition to the lateral lock plate portions 135, in comparison with the receptacle lock fittings 30 of the first embodiment, the locking strength of the entire connector increases in proportion to the end lock plate portions 146, which enables prevention of inadvertent removal of the connectors. However, it is not essential to have both the lateral lock plate portions 135 and the end lock plate portions 146. For example, if sufficient locking strength can be obtained when using only the end lock plate portions 146, the lateral locking recessed portions 135A may be removed from the lateral lock plate portions 135 and it may be unnecessary to impart locking functionality to said lateral lock plate portions 135.

Third Embodiment

In the first embodiment, the upright face-reinforcing lateral plate portions 31 of the receptacle lock fittings 30 were provided only on one side of the protruding wall 12 and were not provided on the other side (side where the power supply contact arm portions 43 were provided), and the lock plate portions facing said lateral face on the other side were not connected to the lock fitting sections retained on the protruding wall 12. By contrast, in the third embodiment, upright face-reinforcing lateral plate portions are provided even on the above-mentioned other side of the protruding wall 12 and the lock plate portions facing said lateral face on the other side are connected to said upright face-reinforcing lateral plate portions, which is a point of difference from the first embodiment.

FIG. 6 (B) is an oblique view illustrating receptacle lock fittings 230 according to the third embodiment. Below, the third embodiment will be described with reference to FIG. 6 (B). In this embodiment, the explanations will focus on the sections different from the first embodiment while sections identical to the first embodiment will be assigned numerals obtained by adding "200" to the numerals used in the first embodiment and the corresponding explanations will be omitted.

This embodiment is an embodiment in which, in comparison with the receptacle lock fittings 30 of the first embodiment, the receptacle lock fittings 230 are further provided with upright face-reinforcing lateral plate portions 244 located adjacent to the power supply contact arm portions 243 in the array direction and connecting bottom portions 245 connecting said upright face-reinforcing lateral plate portions 244 and lock plate portions 235.

In this embodiment, if necessary, the upright face-reinforcing lateral plate portions 231, connecting bottom portions 234, and lock plate portions 235 located on the side where the power supply contact arm portions 243 are not provided are respectively referred to as the "first upright face-reinforcing lateral plate portions 231", "first connecting bottom portions 234", and "first lock plate portion 235", and the upright face-reinforcing lateral plate portions 244, connecting bottom portions 245, and lock plate portions 235 located on the side where the power supply contact arm portions 243 are provided are respectively referred to as the "second upright face-reinforcing lateral plate portions 244", "second connecting bottom portions 245", and "second lock plate portions 235".

As seen in FIG. 6 (B), the width dimensions (dimensions in the above-mentioned array direction) of the second upright face-reinforcing lateral plate portions 244 are smaller than those of the first upright face-reinforcing lateral plate portions 231. Said second upright face-reinforcing lateral plate portions 244 extend in the vertical direction along the lateral face of the protruding wall (not shown) of the housing at locations more external than the power supply contact arm portions 243 in the above-mentioned array direction, with their upper ends being coupled to the face-reinforcing top plate portions 233 and their lower ends coupled to the hereinafter described second connecting bottom portions 245. Said second upright face-reinforcing lateral plate portions 244 have their major surfaces exposed on the lateral face of the above-mentioned protruding wall and are retained in place on said protruding wall.

The second connecting bottom portions 245 are formed with the same width dimensions as said second upright face-reinforcing lateral plate portions 244 at the same positions as the second upright face-reinforcing lateral plate portions 244 in the above-mentioned array direction. Said second connecting bottom portions 245 extend in the connector width direction along the bottom wall of the housing and connect the lower end portions of the second upright face-reinforcing lateral plate portions 244 and the second lock plate portions 235. Said connecting bottom portions 234 have their major surfaces exposed on the upper surface of the above-mentioned bottom wall and are retained in place on said bottom wall.

In addition, in this embodiment, as seen in FIG. 6 (B), the coupling end portions 239B of the coupling portions 239 are not provided at the ends proximate to the second lock plate portions 235 and said coupling portions 239 are separated from the second lock plate portions 235. However, it is not essential for the coupling portions 239 and the second lock plate portions 235 to be separated.

In this embodiment, not only on the side where the power supply contact arm portions 243 are not provided, but also on the side where the power supply contact arm portions 243 are provided, the second lock plate portions 235 are connected to the second upright face-reinforcing lateral plate portions 244 via the second connecting bottom portions 245 such that the second upright face-reinforcing lateral plate portions 244 and the second lock plate portions 235 provide mutual reinforcement. Accordingly, either of the two lock plate portions 235 of the receptacle lock fittings 30 is capable of resisting excessive extraction forces that may act on the plug connector. In other words, inadvertent removal of the plug connector can be prevented in a more reliable manner in comparison with the first embodiment, in which lock plate portions 35 on one side can resist the above-mentioned extraction force.

Although in Embodiments 1 to 3 the receptacle lock fittings were retained in place by unitary co-molding with the housing, said lock fittings may instead be retained in place, for example, by providing retaining groove portions in the housing and press-fitting the lock fittings into said retaining groove portions.

DESCRIPTION OF REFERENCE NUMERALS

1 Receptacle connector
2 Plug connector
10 Housing
11 Bottom wall
12 Protruding wall
13 Perimeter wall
14 Lateral wall
15 End wall
16 Receiving portion
20 Receptacle terminal
30, 130, 230 Receptacle lock fittings
31, 131, 231 Upright face-reinforcing lateral plate portions
32, 132, 232 Upright face-reinforcing end plate portions
33, 133, 233 Face-reinforcing top plate portions
34, 234 Connecting bottom portions
35, 135, 146, 235 Lock plate portions
36, 136, 236 Transitional portions
37, 137, 237 Lateral retained portions
39, 139, 239 Coupling portions
42, 142, 242 Extension portions
43, 143, 243 Power supply contact arm portions
244 Second upright face-reinforcing lateral plate portion
245 Second connecting bottom portion

The invention claimed is:

1. An electrical connector for circuit boards, comprising:

the electrical connector for the circuit boards, which is disposed on a mounting face of a circuit board and which allows for a mating connector to be inserted and extracted therefrom such that a direction of connector insertion and extraction is perpendicular to the mounting face, the electrical connector having terminals and lock fittings arranged such that the direction of the array is a single direction parallel to the mounting face, and a housing that has the terminals and the lock fittings retained thereon in an array form;

the housing has a bottom wall that faces the mounting face, a protruding wall that rises up from the bottom wall and extends in the array direction, and a perimeter wall that rises up from the bottom wall and surrounds the protruding wall; the perimeter wall having a pair of lateral walls that extend in the array direction, and a pair of end walls that extend in the connector width direction perpendicular to the array direction and couple the end portions of the pair of lateral walls; and an annular space between the protruding wall and the perimeter wall is formed as a receiving portion that receives a mating portion of a mating connector from the open side of the annular space; and the lock fittings, which are made by bending sheet metal members, are retained in place on the housing at locations outwards of the terminals in the array direction and are lockable onto a mating connector in the direction of connector extraction; wherein the lock fittings have lock plate portions that extend along the inner surfaces of the lateral walls of the housing and are retained in place on the lateral walls or extend along the inner surfaces of the end walls, and are retained in place on the end walls, upright face-reinforcing plate portions that extend along the upright face of the protruding wall of the housing facing the lock plate portions and are retained in place on the protruding wall, and connecting bottom portions that extend along the bottom wall and connect the bottom wall-adjacent end portions of the upright face-reinforcing plate portions and the lock plate portions.

2. The electrical connector for circuit boards according to claim 1, wherein the lock fittings have face-reinforcing top plate portions that extend from the open-side end portions of the upright face-reinforcing plate portions along the top portion of the protruding wall of the housing and are retained in place on the protruding wall.

3. The electrical connector for circuit boards according to claim 1, wherein the lock fittings have retained portions that extend from the open-side end portions of the lock plate portions via transitional portions towards the bottom wall side of the housing and are retained in place on the housing.

4. The electrical connector for circuit boards according to any of claim 1, wherein the lock fittings have coupling portions that extend along the end walls in the connector width direction, each of the two lateral walls being respectively provided with one lock plate portion, and the two lock plate portions being coupled via the coupling portions.

5. An electrical connector for circuit boards, comprising:

the electrical connector for the circuit boards, which is disposed on a mounting face of a circuit board and allows for a mating connector to be inserted and extracted therefrom such that a direction of connector insertion and extraction is perpendicular to the mounting face, the electrical connector having terminals and lock fittings arranged such that the direction of the array is a single direction parallel to the mounting face, and a housing that has the terminals and lock fittings retained thereon in an array form;

the housing has a bottom wall that faces the mounting face, a protruding wall that rises up from the bottom wall and extends in the array direction, and a perimeter wall that rises up from the bottom wall and surrounds the protruding wall; the perimeter wall having a pair of lateral walls that extend in array direction and a pair of end walls that extend in the connector width direction perpendicular to the array direction and couple the end portions of the pair of lateral walls; and an annular space between the protruding wall and the perimeter wall is formed as a receiving portion that receives a mating portion of a mating connector from the open side of annular space; and the lock fittings, which are made by bending sheet metal members, being retained in place on the housing at locations outwards of the terminals in the array direction and being lockable onto a mating connector in the direction of connector extraction; wherein the lock fittings have:

lock plate portions that extend along the inner surface of each of the respective two lateral walls of the housing and are retained in place on the lateral walls with one lock plate portion provided per wall, upright face-reinforcing plate portions that extend along the upright face of the protruding wall of the housing facing a lock plate portion on one side among the lock plate portions retained in place on each of the two lateral walls and which are retained in place on the protruding wall, connecting bottom portions that extend along the bottom wall and connect the bottom wall-adjacent end portion of the upright face-reinforcing plate portion and the lock plate portion on one side, extension portions that extend from the bottom wall-adjacent end portions of the lock plate portions on the other side along the bottom wall towards the protruding wall, and contact arm portions that extend from the extension portions along the upright face of the protruding wall of the housing facing the lock plate portions on the other side and which can be brought into contact with counterpart terminals provided in a mating connector under a contact pressure as a result of elastic displacement in the connector width direction.

* * * * *